United States Patent [19]

Kohlbeck

[11] 4,098,436

[45] Jul. 4, 1978

[54] HOLDER TO CONVERT SPRAY CAN INTO SPRAY GUN

[76] Inventor: Anthony J. Kohlbeck, 2929 N. 84th St., Milwaukee, Wis. 53222

[21] Appl. No.: 709,656

[22] Filed: Jul. 29, 1976

[51] Int. Cl.[2] ..... B67D 5/54

[52] U.S. Cl. ..... 222/182; 222/474; 239/375

[58] Field of Search ..... 222/402.12, 402.13, 222/402.15, 469, 473–475, 183, 182, 173, 3, 5; 239/375; 141/275

[56] References Cited

U.S. PATENT DOCUMENTS

| | | | |
|---|---|---|---|
| 927,798 | 7/1909 | Hoft | 222/5 |
| 1,590,299 | 6/1926 | Liddell | 141/275 X |
| 2,704,582 | 3/1955 | Bowman | 222/402.15 X |
| 2,868,421 | 1/1959 | Schott | 222/402.15 X |
| 2,960,260 | 11/1960 | Kutik | 222/402.15 X |
| 3,007,613 | 11/1961 | Tygard | 222/402.15 |
| 3,659,791 | 5/1972 | Clark | 222/474 X |
| 3,734,357 | 5/1973 | Botistelli et al. | 222/474 X |
| 3,933,278 | 1/1976 | Anderson | 222/182 |

*Primary Examiner*—Joseph F. Peters, Jr.
*Assistant Examiner*—Norman L. Stack, Jr.
*Attorney, Agent, or Firm*—Alter and Weiss

[57] ABSTRACT

A universal spray can holder is longitudinally adjustable to securely hold an aerosol spray can and features an integral trigger mechanism to actuate the can valve. A built-in safety hood protects the spray can operator from missprayings, and from inhaling either can contents or can propellant.

4 Claims, 3 Drawing Figures

HOLDER TO CONVERT SPRAY CAN INTO SPRAY GUN

This invention relates to holders for spray cans and more particularly to a trigger activated spray can holder adjustable to fit a wide range of spray can sizes.

Use of a typical spray can requires the operator to press a button-operated valve mechanism mounted atop the can thereby completing a path from the interior of the can to a nozzle through which the can contents are forced under pressure by a suitable propellant. Such cans are most conveniently used when only a short burst of the can's contents is required, however, when the valve must be depressed over extended time periods, such as incurred during spray painting operations, considerable manual effort is required on the part of the user. Since such valves are commonly activated by rather small buttons, the can operator also runs the risk of having the contents of the can come into contact with his hand during spraying.

Another difficulty incurred with continuous use of the spray container is misdirection of the spray when the nozzle becomes partially clogged or when the can is misaimed. This can cause the can's contents to be sprayed in a direction other than that desired.

With spray can contents coming increasingly more complex and esoteric it is becoming more critical to provide spray can users with means to more accurately and safely dispense them. Use of spray cans is widespread, and in some instances a product may be offered solely in spray can forms of packaging. It is therefore becoming of greater importance to provide spray can activating mechanisms designed to protect users, as well as to make such cans conveniently operable by those to whom operating the spray can valve presents significant problems. Arthritic or crippled users, for example, may find it difficult to depress the can valve for a sufficient length of time to discharge the quantity of material required.

Prior attempts at providing trigger actuated spray mechanisms for aerosol cans have not been widely or successfully accepted due in part to the inherent difficulty of providing a spray mechanism sufficiently adjustable to accommodate a wide range of aerosol can sizes while still providing safe, convenient trigger mechanisms. Devices such as those exemplified by U.S. Pat. Nos. 2,960,260, 3,112,849, 3,172,582, and 3,506,159 describe devices intended to be clipped to the annular shoulder typically formed on such aerosol cans. To make such devices firmly attachable to aerosol cans often requires close tolerancing, and gripping means must fit either so tightly as to make the mechanism difficult to attach and remove, or so loosely that the mechanism will not remain firmly attached to the can, particularly when pressure is applied to the trigger mechanism. Such mechanisms are limited in use to cans having annular rings matching the dimensions of the gripping means and trigger mechanisms, and are not adjustable.

Devices such as that illustrated at U.S. Pat. Nos. 3,007,613 and 3,045,878 feature gripping means which, although more securely gripping an aerosol can placed therein, still lack the flexibility of adjustment necessary to accommodate cans of varying dimensions.

Accordingly, this invention has the following objects:

To provide spray can holders with trigger mechanisms easily and conveniently useable to activate the can's valve mechanism;

To provide such holders in forms adjustable to accept cans of widely varying sizes;

To provide such holders in forms providing operator protection against accidental missprays;

To provide such holders in forms protecting the operator against excessive skin contact with the can contents or excessive inhalation of spray can propellant; and To provide such holders in forms easily adjustable and inexpensive to manufacture.

These and further objects will become more apparent upon consideration of the accompanied drawings in which.

Figure 1:
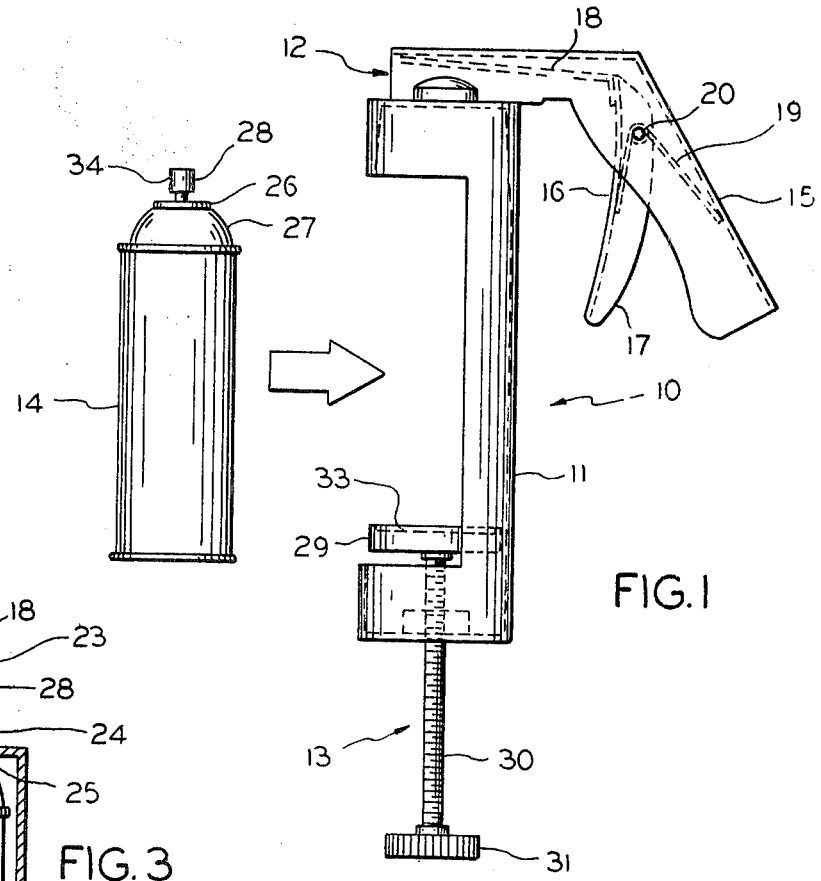
FIG. 1 is a side elevation of the inventive spray can holder illustrating insertion of a spray can therein.

Consistent with the foregoing objects, applicant herein provides a trigger actuated holder 10 for an aerosol can 14 having a depressable valve button 28, such mechanism having a body 11 with two ends, one said end featuring threadably adjustable clamp member 13 to grip can 14 between said two ends, an integral safety hood 12 to prevent spray from accidentally striking a user, and a trigger means 16 selectively operable to depress valve button 28, thereby releasing the can's contents for use.

Referring now to FIG. 1, the numeral 10 indicates generally a holder for spray cans having a body 11, upper housing 12, and adjustable clamp mechanism 13.

Body 11 is shaped to accommodate spray can 14 and is of sufficient length to enable insertion of spray cans varying greatly in size.

Upper housing 12 features integral handle 15, housing trigger mechanism 16, including trigger 17, trigger extension 18 and bias spring 19. Trigger 17 is pivotally mounted in handle 15 at pivot 20, and spring 19 is placed to hold trigger 17 and trigger extension 18 in the unstressed positions illustrated in FIG. 1. Pivot 20 is situated at a point approximately 80% of the distance between the outer end of trigger 17 and the end at which trigger 17 abuts trigger extension 18. This enables the force exerted on trigger 17 to be transmitted to trigger extension 18 at aproximately a 4:1 ratio.

Figure 3:
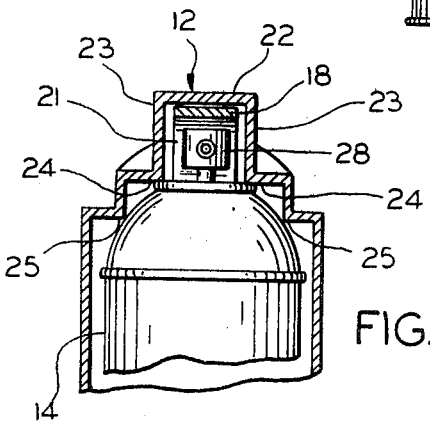
FIG. 3 is a sectional view along 3.3 of FIG. 2.

Upper housing 12 further includes spray chamber 21 formed by upper housing wall 22 and side walls 23 of handle 15. As illustrated in FIG. 3, upper housing 12 has a somewhat stepped cross-section below chamber 21, forming shoulders 24 and 25. Said shoulders are provided to abut crimped ring 26 or can shoulder 27 of spray can 14 to increase can's 14 stability within the holder.

Valve button 28 of can 14 is accommodated by spray chamber 21 and is thus positioned such that trigger extension 18, in its normally unstressed attitude extends directly above valve button 28.

Adjustable clamp mechanism 13 includes clamp platform 29 mounted to threaded shaft 30 and knob 31. Threaded shaft 30 extends notatably into body 11 through tapped aperture 32; rotating knob 31 thereby raises or lowers platform 29 within body 11. Platform 29 features a circular inset portion 33 to accommodate the bottom of can 14.

Figure 2:
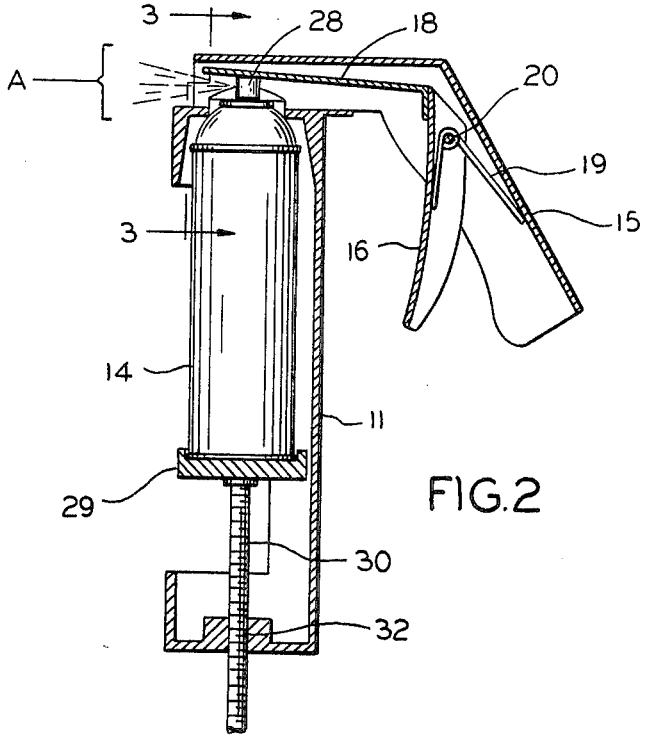
FIG. 2 is a lateral sectional view of the holder shown in FIG. 1 illustrating the spray can fastened into position.

To use spray holder 10, knob 31 is rotated to bring platform 29 to its lowered position sufficient to enable insertion of can 14 into body 11. Upon insertion, can 14 is oriented to aim nozzle 34 of valve button 28 in a forward-facing position outward from spray hood 21. Knob 31 is then rotated to raise platform 29 to engage the bottom of can 14 as illustrated in FIG. 2. Thereafter, platform 29 is raised until can 14 is snugly abutted to either shoulder 24 or 25 of upper housing 12.

The user then grips handle 15 and trigger 17. By exerting pressure on trigger 17, trigger extension 18 is urged downward to contact valve button 28 thereby depressing said button enabling the contents of can 14 to exist through nozzle 34 as illustrated at A of FIG. 2.

Should the ensuing spray from can 14 be misdirected either through clogging of nozzle 34 or improper positioning of can 14 in can holder 10, spray hood 21 act as a safety device by limiting the travel of any such misdirected spray, particularly in the direction of the spray can operator. Use of spray can holder 10 also enables a operator to spray holding the can at arms' length thereby lessening the likelihood of either the can's contents or propellant coming into contact with the operator's face or body.

While the foregoing has presented a particular embodiment of the invention herein claimed, it is to be understood that this embodiment is presented by way of example only. It is expected that others skilled in the art will perceive a variation which while differing from the foregoing do not depart from the spirit and scope of the invention.

I claim:

1. A hand held holder for an aerosol spray can of the type actuated by a valve button, said valve button positioned at the top of said can, said holder comprising:

a unitary body shaped to accommodate said can, said body having two ends;

a clamp threadably cooperating with the first of said ends, said clamp being adapted to engage said can and urge said can toward the second of said two ends;

a hood, said hood being integral with said body at said second of said two ends, said hood including at least one internal shoulder shaped to non-clampingly abut the top of said can, said hood being shaped to surround said valve button;

a handle integral with said hood; and a trigger mechanism mounted within said handle, said trigger mechanism including a trigger extension rod positioned to extend above said valve button, said rod adapted to contact and depress said valve button when said trigger is actuated.

2. A trigger-actuated holder for aerosol cans of the type having a top with a valve actuated by a depressible valve button, said holder comprising:

a unitary body having two ends, said body having a generally C-shaped configuration, means to grip one said can within said body, said gripping means including means formed at the first of said body ends to engage said top, said gripping means further including means to contact said top between said first and second ends, said clamping means cooperating with said body at said second of said ends, said clamping means being selectively adjustable to positions intermediate said ends;

means for hooding said valve and said valve button, said hood means being hollow and integral with said body, said hood means being shaped to receive said valve button therewithin;

a handle integral with and extending from said body;

means to trigger said valve button, said trigger means being mounted within said handle and extending into said hood means to be positioned above said valve button, said trigger means being adapted to selectively contact and depress said valve button.

3. The apparatus as recited in claim 2 wherein said trigger means includes an extension level extending into said hood means and positioned above said valve button.

4. The apparatus as recited in claim 2 wherein said hood means further includes at least one annular shoulder, said annular shoulder adapted to non-clampingly engage said top.

* * * * *